US007083154B2

(12) United States Patent
Holm

(10) Patent No.: US 7,083,154 B2
(45) Date of Patent: Aug. 1, 2006

(54) DEVICE FOR HOLDER FOR CONTAINER FOR LIQUID PRODUCTS FOR APPLICATION ON A WALL

(75) Inventor: Harry Holm, Munkfors (SE)

(73) Assignee: Holms Trading AB, Munkfors (SE)

( * ) Notice: Subject to any disclaimer, the term of this patent is extended or adjusted under 35 U.S.C. 154(b) by 0 days.

(21) Appl. No.: 10/494,361

(22) PCT Filed: Nov. 12, 2002

(86) PCT No.: PCT/SE02/02051

§ 371 (c)(1),
(2), (4) Date: Jun. 17, 2004

(87) PCT Pub. No.: WO03/059137

PCT Pub. Date: Jul. 24, 2003

(65) Prior Publication Data

US 2005/0029422 A1 Feb. 10, 2005

(30) Foreign Application Priority Data

Nov. 13, 2001 (SE) ..... 0103748

(51) Int. Cl.
*A47K 1/08* (2006.01)

(52) U.S. Cl. ..... 248/311.3; 222/181.2

(58) Field of Classification Search ..... 248/311.3, 248/300, 311.2, 312; 222/181.2, 214, 325
See application file for complete search history.

(56) References Cited

U.S. PATENT DOCUMENTS

| | | | | |
|---|---|---|---|---|
| 4,164,306 | A * | 8/1979 | Perrin | 222/181.2 |
| 4,930,667 | A | 6/1990 | Holzner, Sr. | |
| 4,932,624 | A | 6/1990 | Holm | |
| 5,207,355 | A | 5/1993 | Thomson | |

FOREIGN PATENT DOCUMENTS

| | | |
|---|---|---|
| EP | 0433905 | 1/1991 |
| WO | 0074545 | 12/2000 |

* cited by examiner

*Primary Examiner*—Ramon O Ramirez
(74) *Attorney, Agent, or Firm*—Dennison, Schultz & MacDonald

(57) ABSTRACT

In dispensers for liquid products bags, with a hose-like emptying opening at the lower end of the bag are used, with emptying achieved by compression of the hose. Emptying is improved if two flat surfaces approach each other and additional improvement is obtained if the surfaces are provided with means to achieve throttling prior to compression.

4 Claims, 11 Drawing Sheets

DEVICE FOR HOLDER FOR CONTAINER FOR LIQUID PRODUCTS FOR APPLICATION ON A WALL

BACKGROUND OF THE INVENTION

This application is a filing under 35 USC 371 of PCT/SE02/02051 filed Nov. 12, 2002.

The present invention relates to a holder for a container for liquid products. A device for a holder for a container for liquid products for application on a wall is known, which container may be made of various materials such as plastic, glass, paper, metal or the like and which may be in the nature of a bag or bottle with a preferably detachable closure means that is elongate, which includes a dosing member such as a pump arrangement that can be influenced externally transversely and manually by part of an actuating member such as a lever pivotably journalled in the holder, the container with an elongate closure means being designed to rest against the container, the blank for the container consisting of a substantially rectangular plate with a longitudinal and a transverse extension, which plate in its longitudinal direction has a longitudinally-running through-slot with two parts arranged one on each side of the slot and which plate is shaped substantially as a U about an axis perpendicular to the slot, the plate part on one side of the slot being bent inwards so that the plate part forms a U-like part that is intended with its outer part to surround and limit lateral movement of the elongate closure means and the plate part on the other side of the slot retaining its outwardly directed shape and with its inner part being intended to partially surround the container and its elongate closure means.

SUMMARY OF THE INVENTION

The object of the present invention is to provide a device such that upon movement of the actuating member a predetermined amount of the liquid product is supplied. In accordance with the present invention this is achieved by said hose-like part being squeezed together along a predetermined length thereof so that said part is totally emptied of its contents. This is achieved by the actuating member cooperating with the outer surface of the inwardly bent part of the rectangular plate. Said outer surface cooperates with a part of the actuating member which is substantially parallel with said surface in inserted position. It is thus suitable for the actuating member in inserted position to have a part that is parallel with said outer surface. The quantity of product squeezed out will thus be determined by the length of the part of the actuating member that cooperates with said outer surface of the inwardly bent part. It is thus suitable for the inwardly bent part to have an entirely flat rectangular surface at its centre. The actuating member may also be provided with a plate cooperating with the surface just mentioned.

The actuating member and/or the inwardly bent outer surface may be provided on the side closest to the container with means to throttle the hose before the squeezing effect occurs. The liquid product from the hose is thus prevented from returning to the container. The hose may be provided at its free end with a valve that is resilient and always assumes closed position but which, upon being influenced by pressure from the liquid product in the hose, opens and permits a certain quantity to be released.

BRIEF DESCRIPTION OF THE DRAWINGS

For further understanding of the present invention, known devices will first be described with reference to eleven accompanying drawings, and thereafter the invention with reference to two accompanying drawings in which.

DESCRIPTION OF THE PREFERRED EMBODIMENTS

Figure 1:
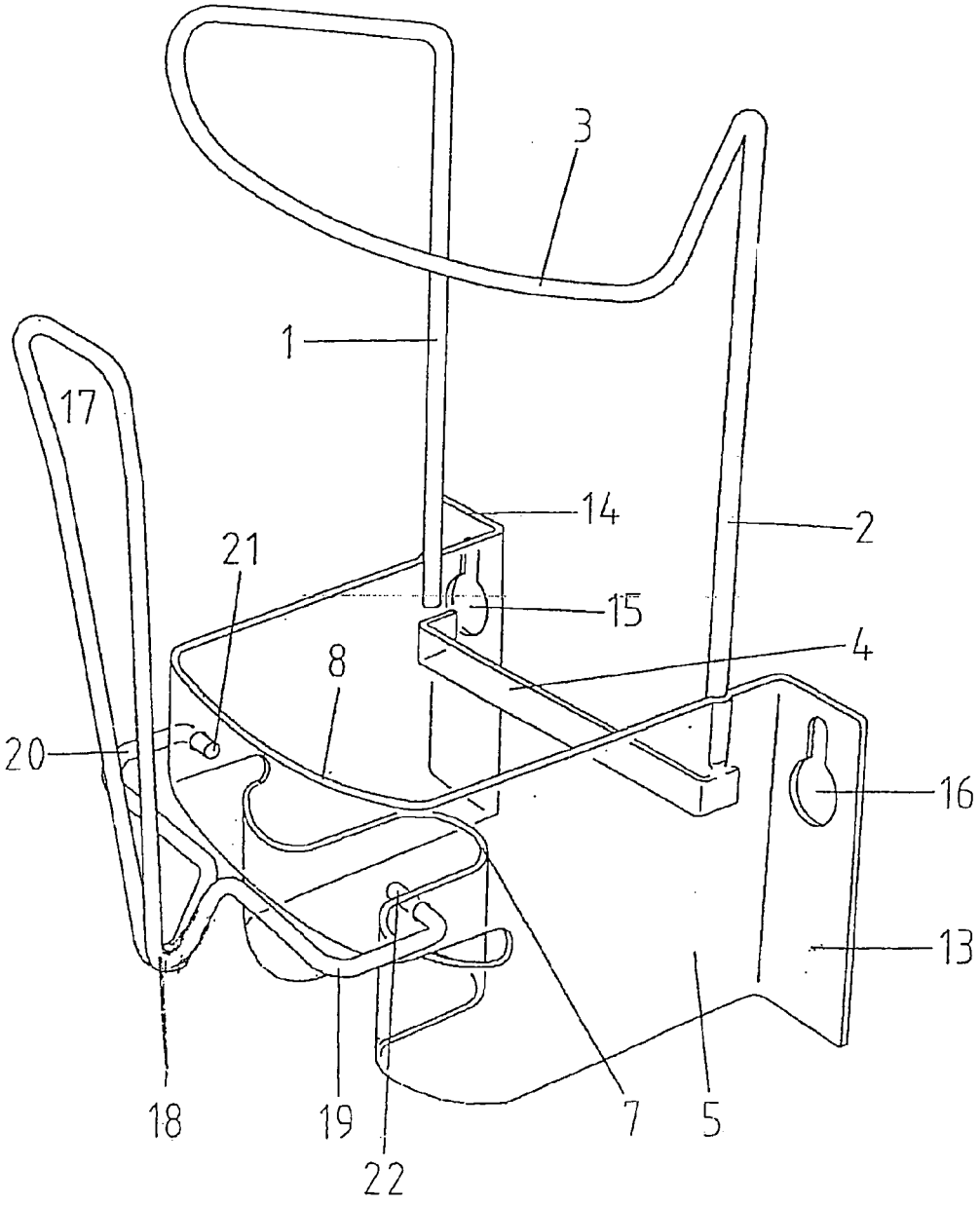
PRIOR ART Fig. 1
FIG. 1 shows a known holder, FIG. 2 a blank for manufacturing the holder shown in FIG. 1.
Figure 2:
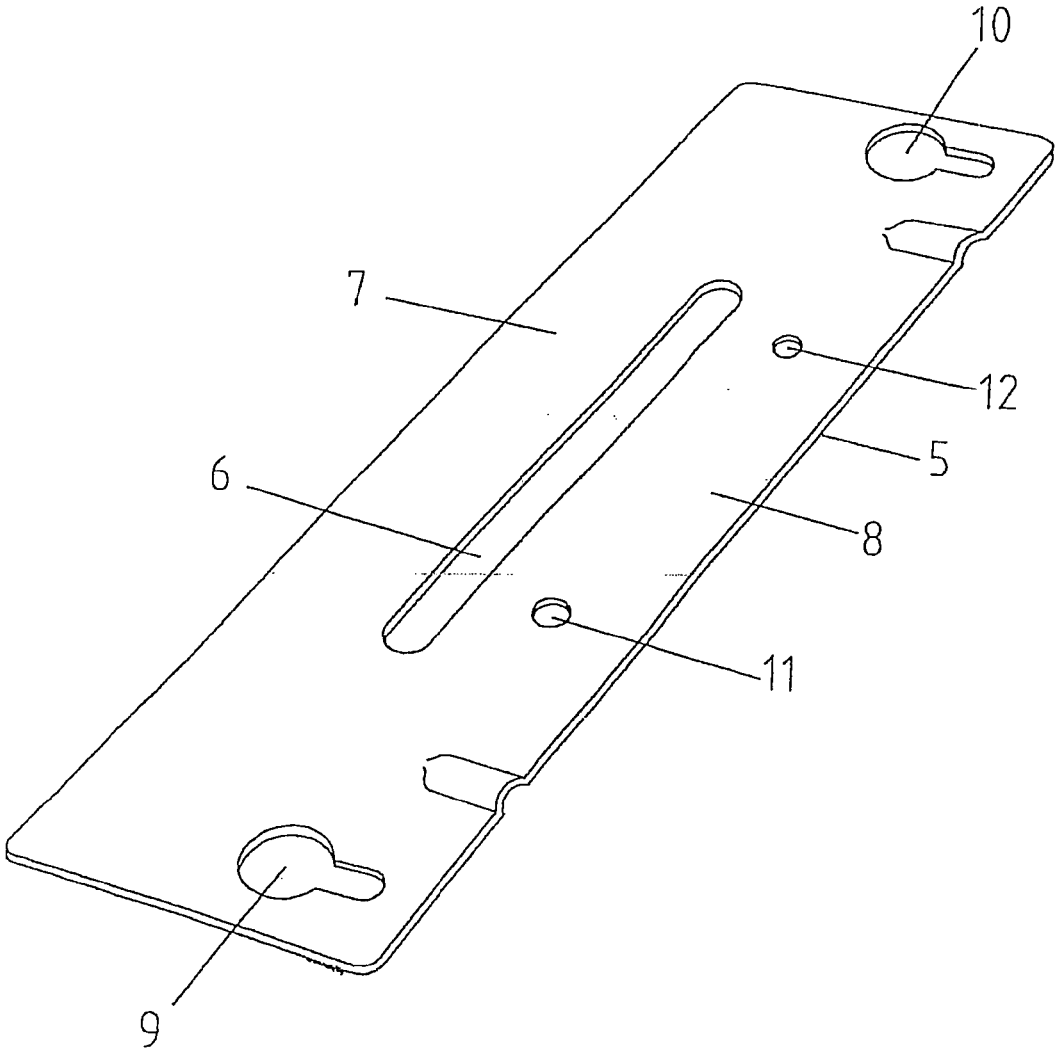
PRIOR ART Fig. 2

Let us consider FIGS. 1 and 2 showing a known holder and material required for its manufacture. A rectangular plate is used initially, which is provided with a central opening 6 and two plate-shaped parts 7 and 8, one on each side of the slot. Holes 9 and 10 are also provided for attaching the bent plate. The plate illustrated in FIG. 2 is bent in the manner shown in FIG. 1 where the plate 5 is U-shaped. It is the part of the plate to the right of the slot 6 that forms the upper part 8 of the holder and the part to the left of the slot 6 that forms the inwardly bent wall 7 that is to constitute the contact wall against a tapping part of a container with liquid products. The bent unit has two attachment flanges 13 and 14 with holes 15 and 16 for attachment screws. From the bent unit 5 extend two rods 1 and 2 with a curved part 3 and the intention is for a bag or bottle to be inserted between the curved part and the straight parts, down to the inwardly bent wall 7. The parts of the receptacle near the inwardly bent part of the holder are influenced by the actuator 17 with two side arms 19 and 20 provided at their free ends with pins 21 and 22 journalled in holes 11 and 12 in the bent metal plate 5.

Figure 3:
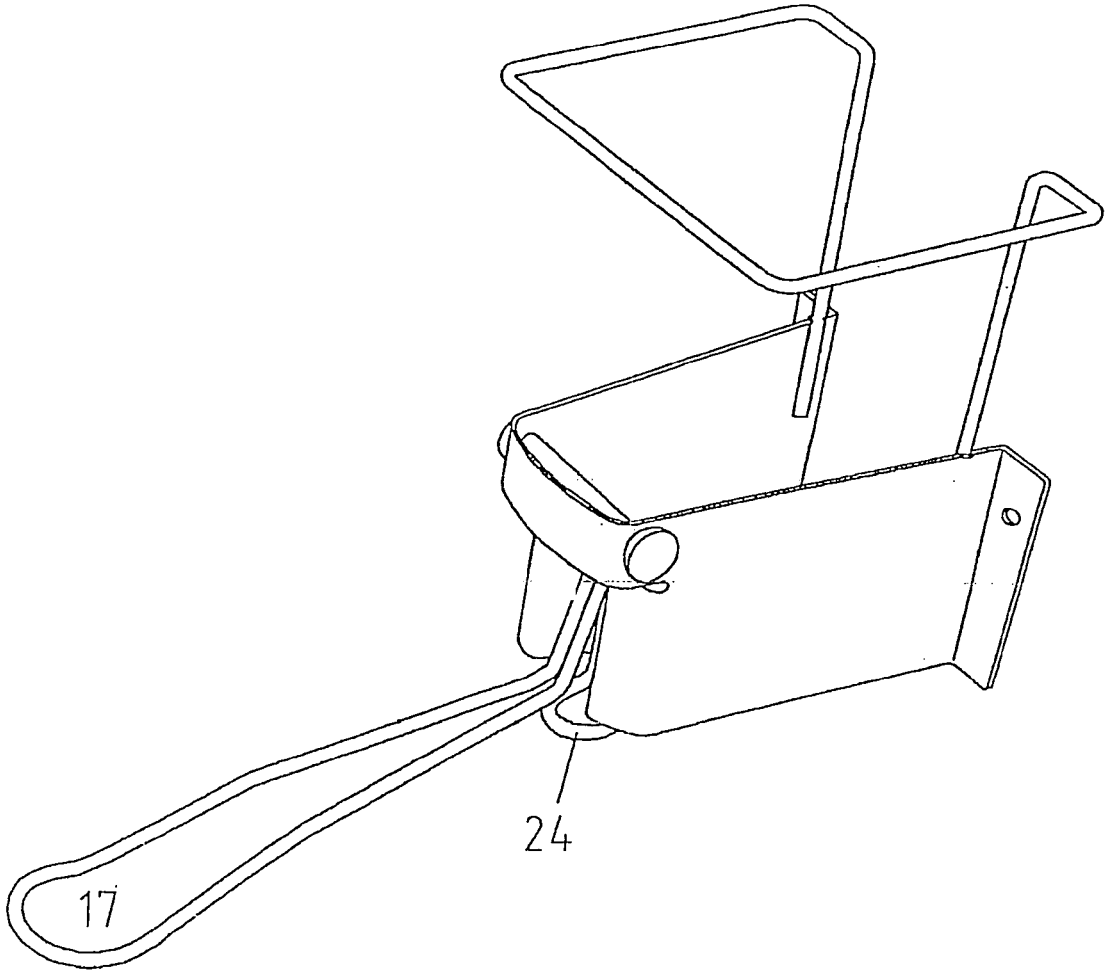
PRIOR ART Fig. 3
FIG. 3 shows an altered prior art holder.

Another known device has been developed which deviates somewhat from the holder shown in FIG. 1 in that the holder part 8 has been made considerably shorter and the actuator is arranged differently, having a longer, flat, straight part 18 that shall be brought more or less into contact with a tubular part 25 which also requires a support 24 for its free end. The most important feature of the holders illustrated in FIGS. 3 and 4 is that they are suitable for receptacles containing liquid products and having a long pipe such as the discharge pipe 25 which may include a pump or other means of discharging liquid.

Figure 4:
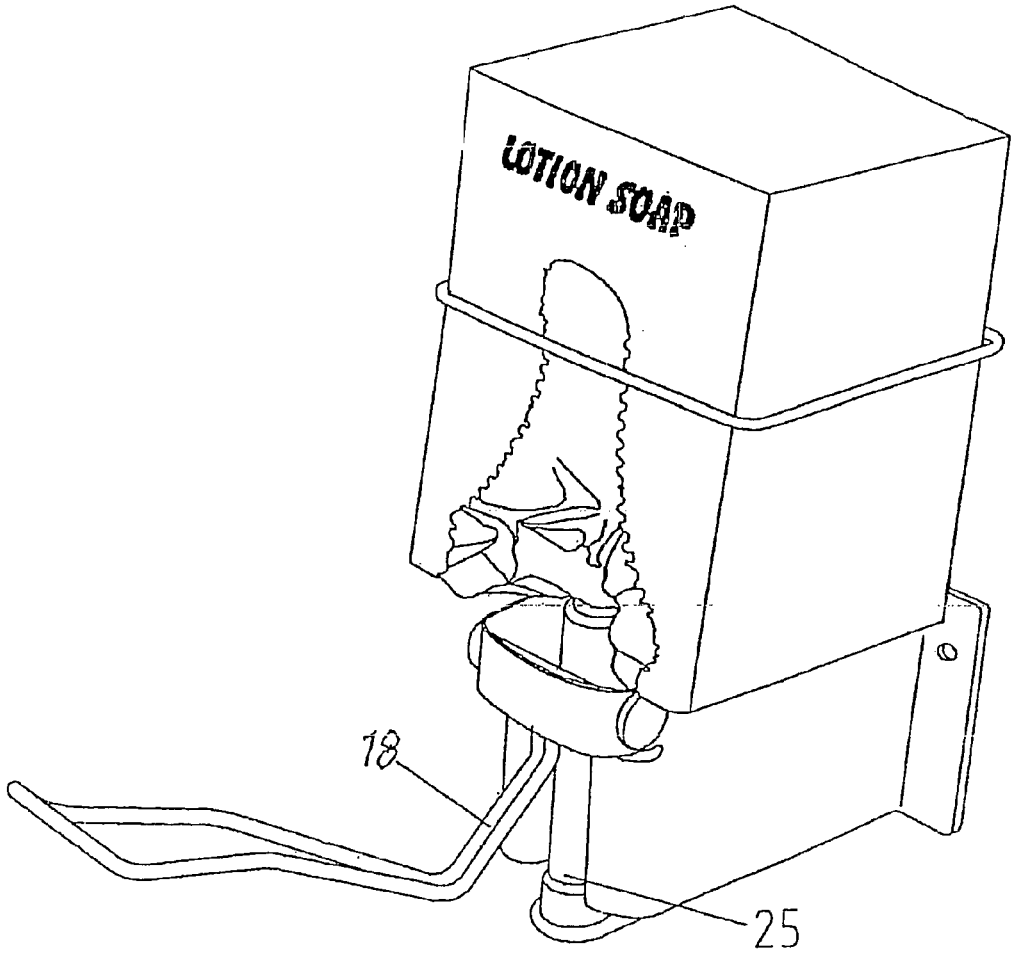
PRIOR ART Fig. 4
FIG. 4 shows the holder in FIG. 3 provided with a tubular tapping arrangement.
Figure 5:
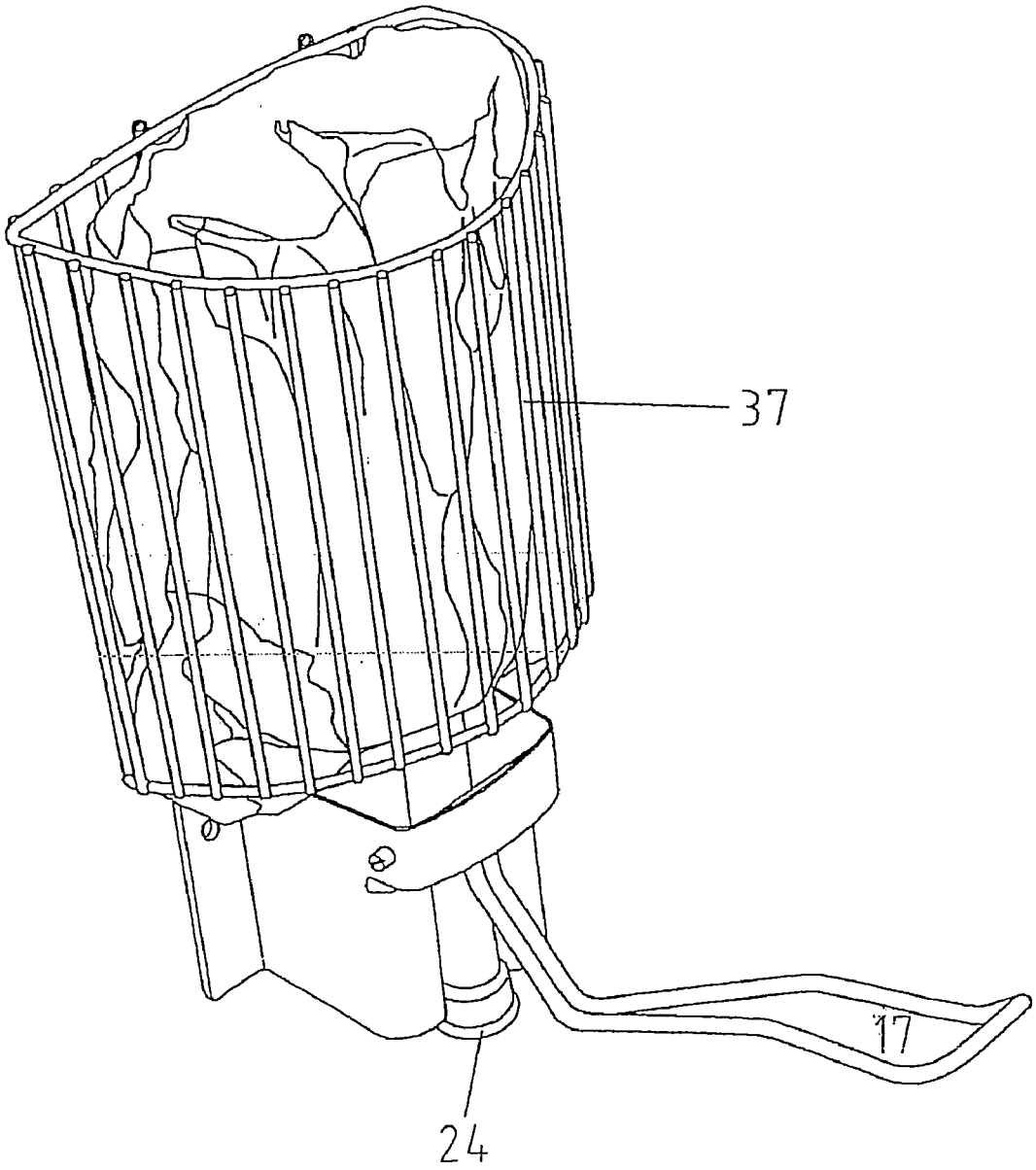
PRIOR ART Fig. 5
FIG. 5 shows a casing for a prior art holder, the casing being peripheral and wherein its cross section may be of various types, the casing can be made of any suitable material whatsoever and it may be smooth material, the casing can also consist of a number of slats spaced from each other, the casing can also consist of a mesh frame.
Figure 6:
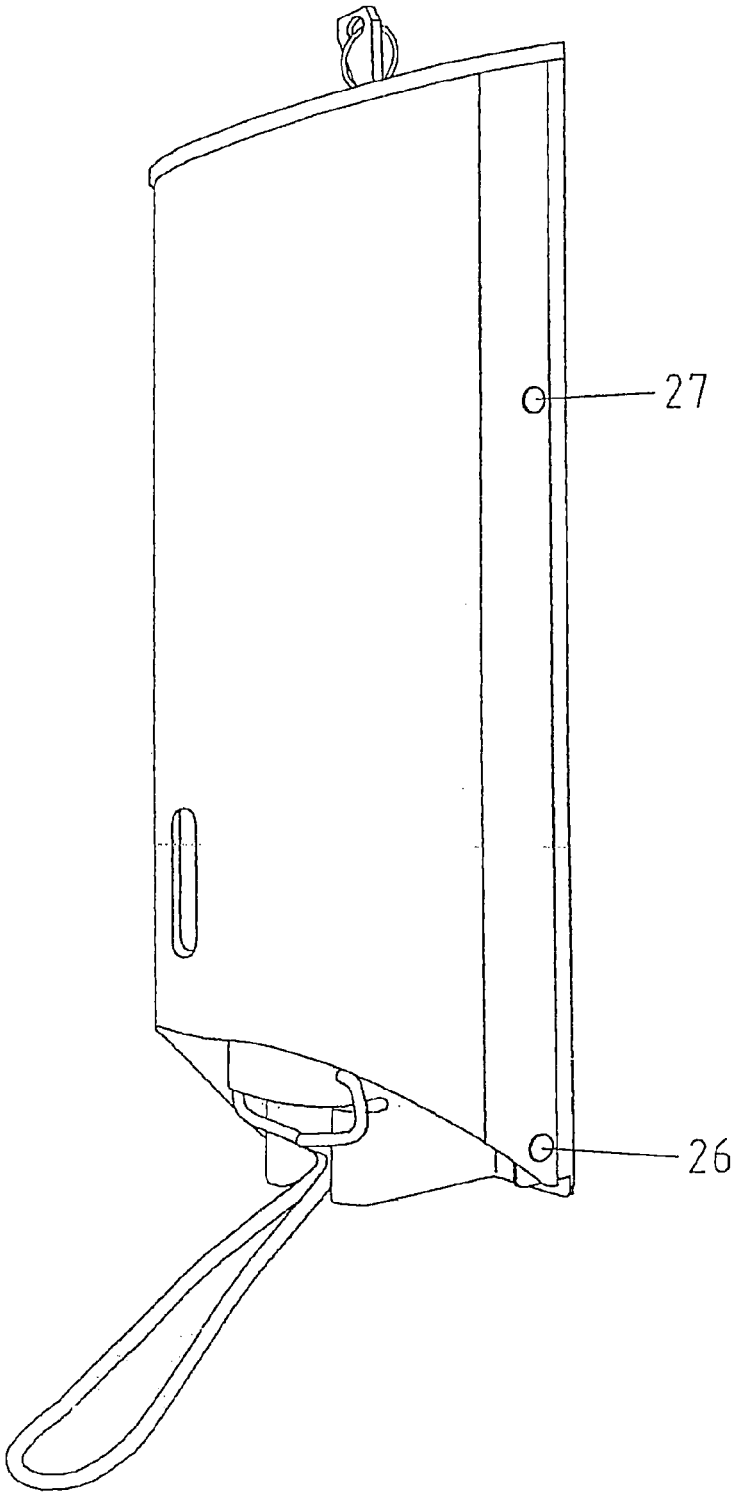
PRIOR ART Fig. 6
FIG. 6 shows a prior art casing that entirely encloses the container with the liquid product and can also be locked.
Figure 7:
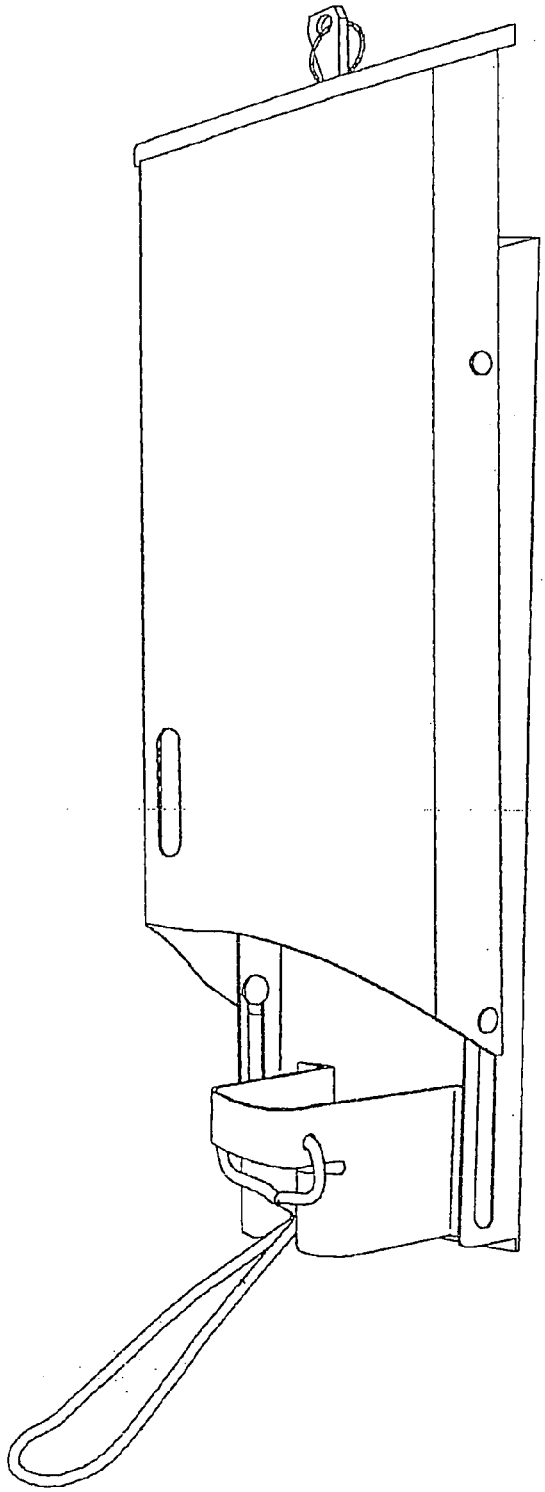
PRIOR ART Fig. 7
FIG. 7 shows the casing in FIG. 6 in a first opening stage.
Figure 8:
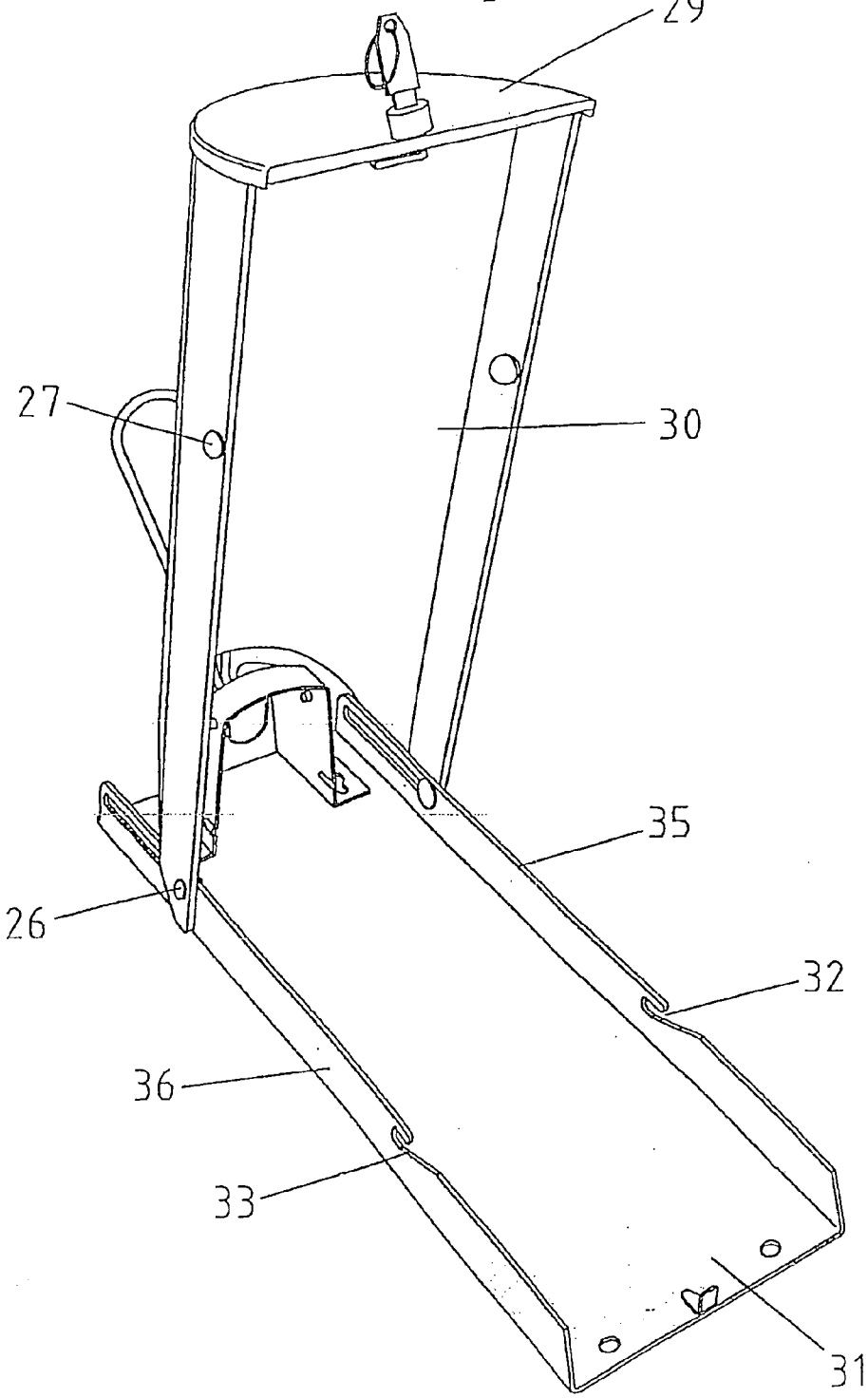
PRIOR ART Fig. 8
FIG. 8 shows the casing in FIG. 6 fully opened.
Figure 9:
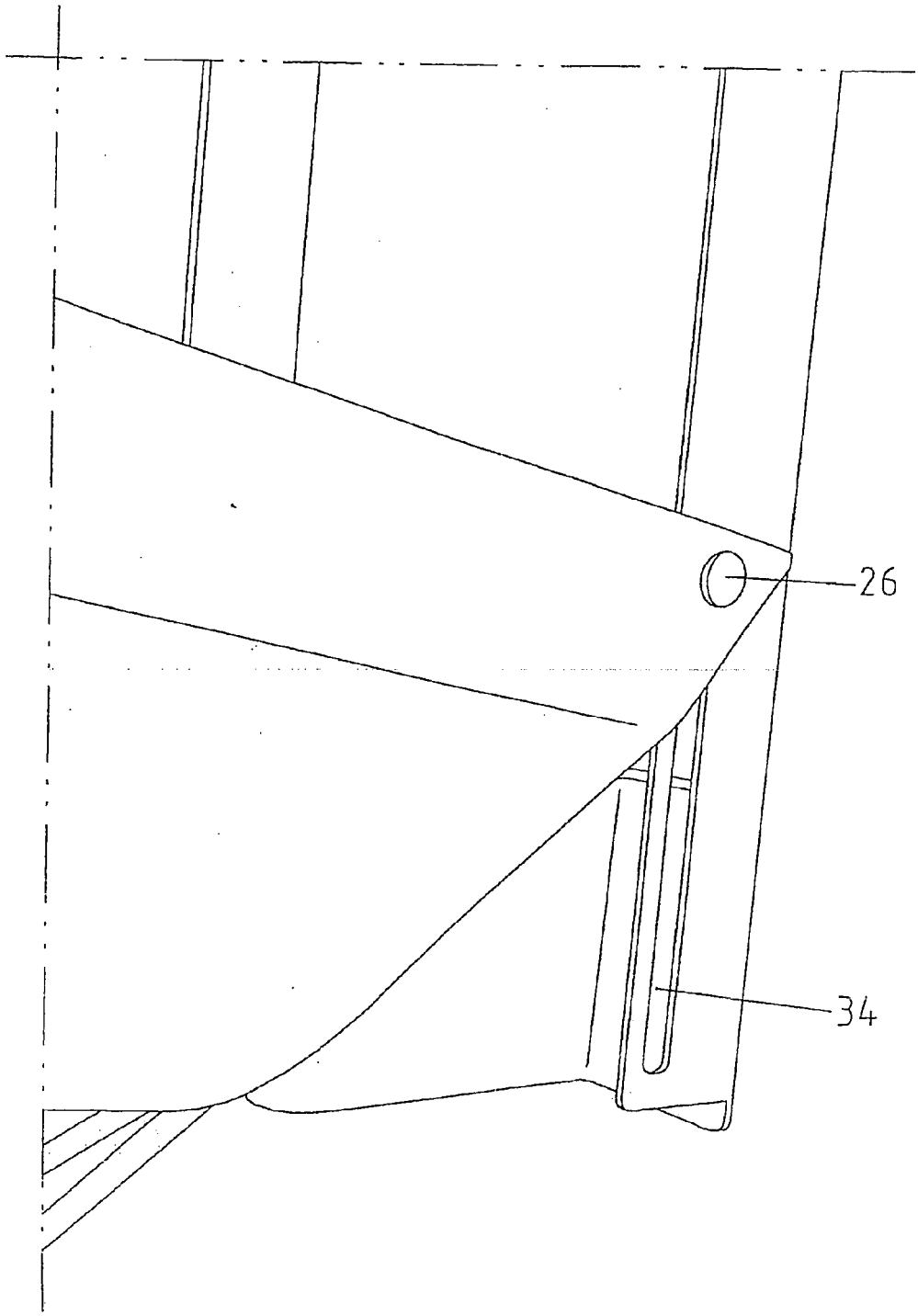
PRIOR ART Fig. 9
FIG. 9 shows one of the two closed slots of the domed outer casing for its journalling.

FIG. 5 illustrates a device similar to that shown in FIG. 4 but with a tubular casing, optional in shape, into which casing a box with contents as in FIG. 4 can be inserted. The casing may have a smooth surface or it may consist of a number of parallel slats arranged one after the other, or of a mesh frame. In certain cases it is desirable to surround a receptacle containing liquid products with a protective casing so that it cannot be interfered with. In this case a double casing is used consisting of a flat part 31 with two side flanges 35 and 36 cooperating with a domed casing 30. This is provided at its lower end with journalling pins 26 running in closed slots 34, i.e. the journalling pins 26 are displaceable from one end of the slot to its other end. If the domed part 30 is flapped down towards the part 31 the studs 27 will engage in the grooves 32 and 33 which have openings. Thus, if the domed part 30 is flapped down towards the part 31 the studs 27 will cooperate with the grooves 32 and 33 and in closed position the domed part 30 can be moved to the lower end of the slot 34 and in this position the domed part 30 can be locked to the flat part 31 so that the receptacle with liquid products is inaccessible for damage. As can be seen in FIG. 7, to open the domed outer casing it must be moved upwards some distance until it can be folded out and assume a position perpendicular to the part 31. The reason for this upward movement is, when the domed casing is down, to protect the actual holder arrangement. It should be evident that the casing described in FIGS. 6, 7 and 9 can very well be used for holders other than the one depicted in the description.

The known arrangements described above have the drawback that it is impossible to discharge a specific quantity of liquid product.

Figure 10:
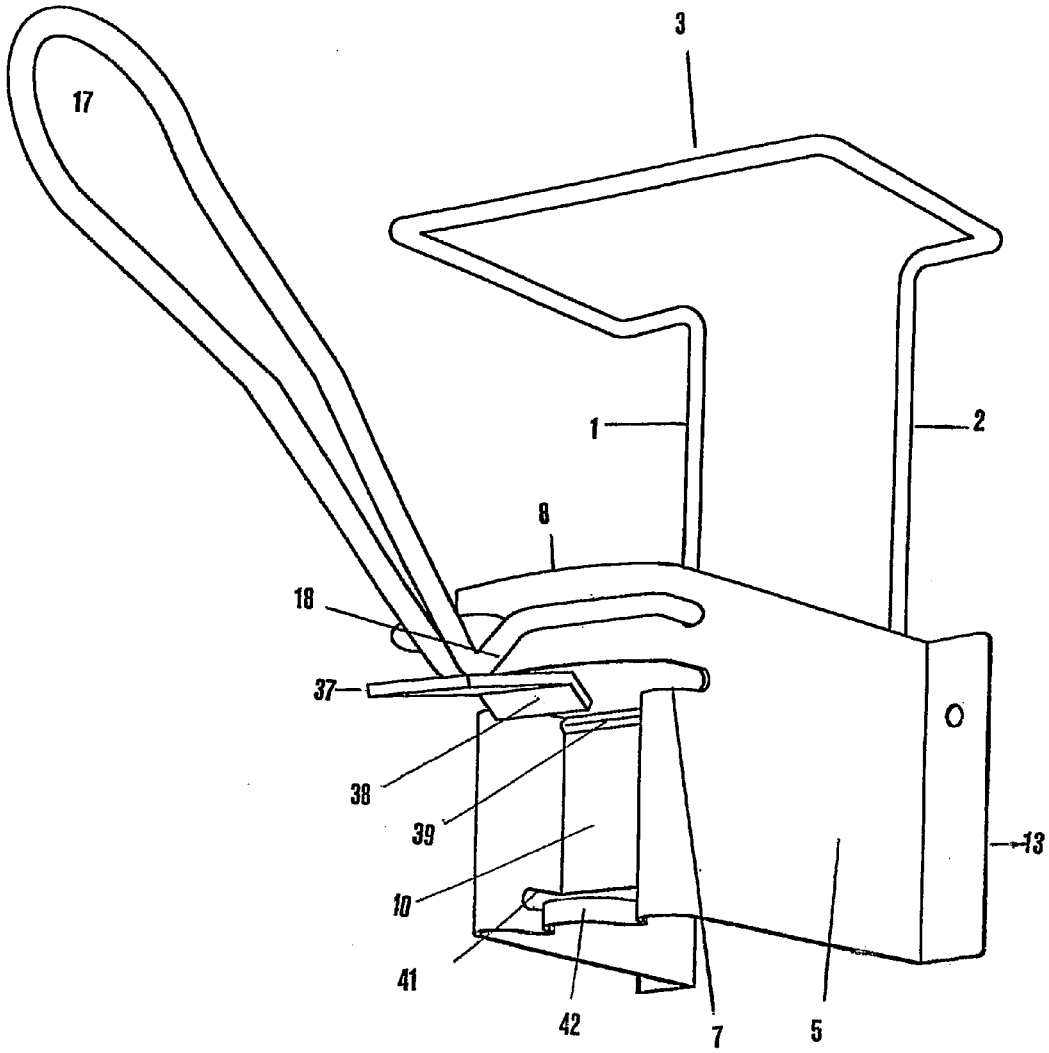
FIG. 10 shows a first squeezing device according to the invention.
Figure 11:
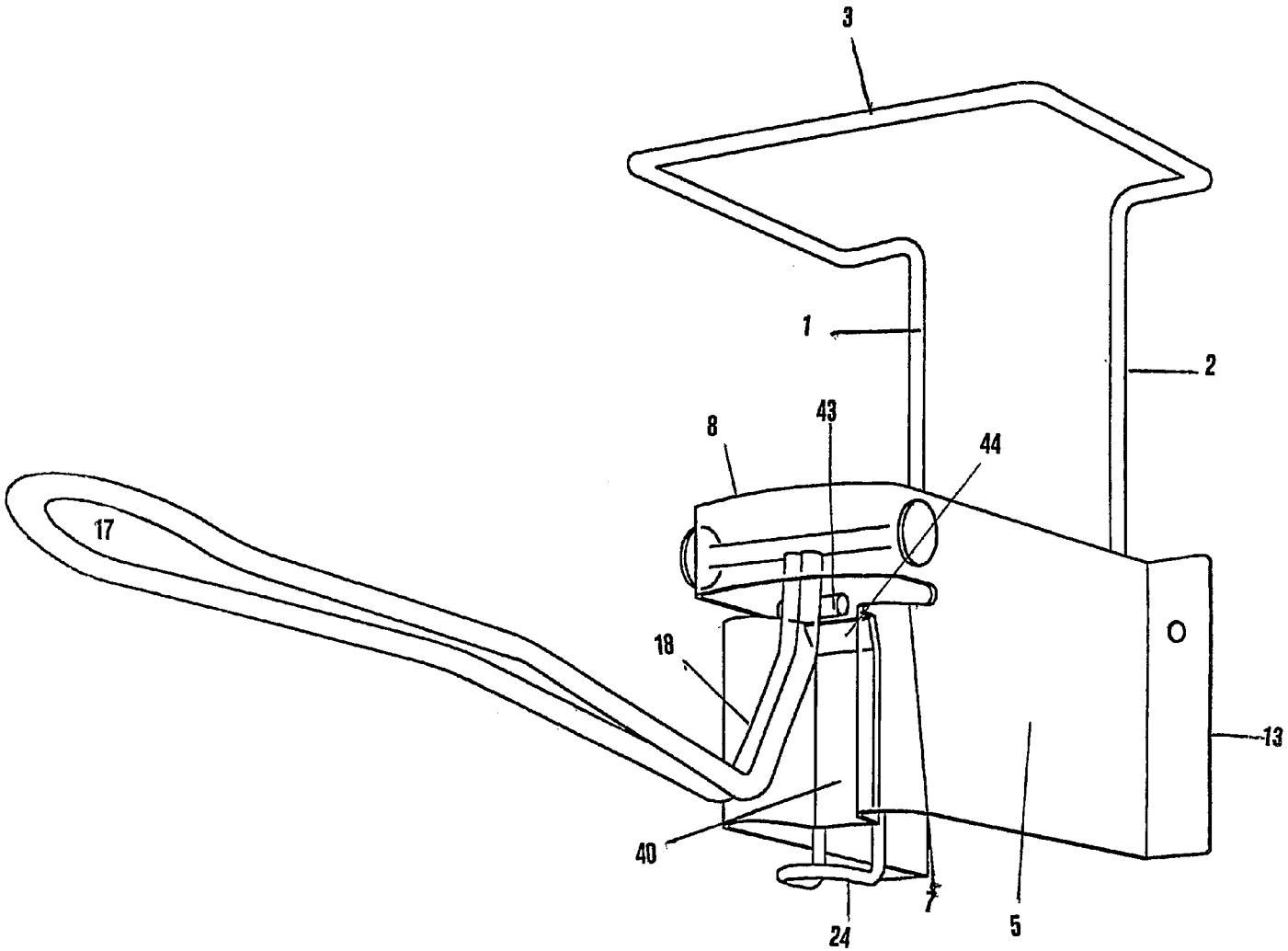
FIG. 11 shows a second squeezing device according to the invention.

An embodiment of the present invention will now be described in more detail with reference to FIG. 10. This embodiment differs from, that described above in that the inwardly bent part 7 is provided at its mid-section with a flat surface 40 and in that the part 18 of the lever 17, see FIGS. 10 and 11, is provided with a plate 37 intended to cooperate with the flat surface 40 in such a way that when the lever is in its lowermost position the plate 37 and surface 40 will be substantially parallel and, upon further depression, the hose 25 within will be entirely compressed along a length corresponding to the length of the plate 37. The plate 37 has an outwardly bent part 38, as is also the case at the upper end of the flat surface of the inwardly bent part where a flange 39 or the like is arranged, whereupon the parts 38 and 39 throttle the hose 25 before the hose is compressed by the parts 37 and 40. The flat plate 5 (see FIG. 2) is also provided with a second groove 41 and, thanks to this, a protruding part 42 is obtained that can serve as support for the hose. It may be suitable to arrange a resilient valve at the end of the hose, this valve being designed to open and release the predetermined quantity of liquid product when liquid product from the hose subjects the valve to pressure.

FIG. 11 shows a second embodiment of the present invention differing from the previous embodiment in that the plate 37 has been replaced by a specially shaped part 18 of the lower part of the lever 17. The lower part 18 will function in exactly the same way as the part 38 of the plate 37. Furthermore, the inwardly bent part 7 has an inwardly curved flange 44 at its upper end, corresponding to the unit 39 in FIG. 10. A transverse part 43 attached on the specially shaped part 18 of the lever 17 cooperates with the above-mentioned unit.

In the above throttling was achieved with the aid of two parts that were movable in relation to each other. Naturally throttling may be achieved in any manner whatsoever. The valve arrangement at the end of the hose may also be designed in various ways that offer the same function as that described.

The invention claimed is:

1. A wall mounted device for holding a container for a liquid product and for dispensing a metered amount of the liquid product through an elongate closure means, comprising:

an external, transverse manual actuating member comprising a lever pivotably journalled in the holder, a blank comprising a substantially rectangular plate with a longitudinal and a transverse extension, the plate having in its longitudinal direction a longitudinally-extending through-slot with two parts arranged with one on each side of the slot, the plate being bent substantially into a U-shape about an axis perpendicular to the slot, a first plate part on one side of the slot being bent inwardly so that the first plate part forms a generally flat surface, with the inwardly bent part adapted to receive the elongate closure means in a direction perpendicular to the slot, and a second plate part on the other side of the slot retaining its outwardly directed shape and having an inner portion adapted to partially surround the container and the elongate closure means, the actuating member comprising a plate unit attached to the lever and having a flat surface having a width oriented in a direction generally parallel to the slot and disposed such that the elongate closure means is between the flat surface and the generally flat outer surface of the inwardly bent part, wherein the surface of the plate unit is movable to be parallel in a lengthwise direction with the outer surface of the inwardly bent part, with the surface of the plate unit fitting within the bent portion, thereby adapted to fully compress a portion of the elongate closure means therebetween.

2. A device as claimed in claim 1, wherein at least one of the compressed parts is provided with throttle means so arranged that throttling is achieved prior to compression.

3. A device as claimed in claim 1, wherein the plate has a second slot so that the inwardly bent part is surrounded by two outwardly directed parts.

4. A device as claimed in claim 1, wherein the plate unit comprises an outwardly bent portion having an edge surface which is adapted to compress the elongate closure means.

* * * * *